US009576709B2

(12) United States Patent
Sarver et al.

(10) Patent No.: US 9,576,709 B2
(45) Date of Patent: Feb. 21, 2017

(54) TRANSFORMER HAVING A STACKED CORE

(75) Inventors: Charlie Sarver, Rocky Gap, VA (US); William E. Pauley, Jr., Bland, VA (US)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 13/642,266

(22) PCT Filed: Apr. 14, 2011

(86) PCT No.: PCT/US2011/032476

§ 371 (c)(1),
(2), (4) Date: Feb. 5, 2013

(87) PCT Pub. No.: WO2011/133391

PCT Pub. Date: Oct. 27, 2011

(65) Prior Publication Data

US 2013/0147588 A1 Jun. 13, 2013

Related U.S. Application Data

(60) Provisional application No. 61/326,850, filed on Apr. 22, 2010.

(51) Int. Cl.

| | |
|---|---|
| ***H01F 30/12*** | (2006.01) |
| ***H01F 27/24*** | (2006.01) |
| ***H01F 27/28*** | (2006.01) |
| ***H01F 3/02*** | (2006.01) |
| ***H01F 27/245*** | (2006.01) |
| ***H01F 41/02*** | (2006.01) |

(52) U.S. Cl.

CPC ..... *H01F 3/02* (2013.01); *H01F 27/245* (2013.01); *H01F 41/02* (2013.01); *H01F 41/0233* (2013.01); *Y10T 29/49073* (2015.01)

(58) Field of Classification Search

CPC ..... H01F 30/12; H01F 27/245; H01F 27/25; H01F 30/02; H01F 27/385; H01F 27/0233; H01F 41/02; H01F 3/02

USPC ..... 336/5, 170, 212, 214, 216, 217, 234

See application file for complete search history.

(56) References Cited

U.S. PATENT DOCUMENTS

| | | | |
|---|---|---|---|
| 2,467,823 | A | 4/1949 | Gordy |
| 2,628,273 | A | 2/1953 | Somerville |
| 2,898,565 | A | 8/1959 | Fox et al. |
| 3,157,850 | A | 11/1964 | Winter et al. |
| 3,270,307 | A | 8/1966 | Jean et al. |

(Continued)

FOREIGN PATENT DOCUMENTS

| | | |
|---|---|---|
| DE | 3623271 A1 | 7/1986 |
| JP | 62-026805 | 2/1987 |

(Continued)

*Primary Examiner* — Elvin G Enad
*Assistant Examiner* — Kazi Hossain
(74) *Attorney, Agent, or Firm* — Taft Stettinius & Hollister LLP

(57) ABSTRACT

A transformer is provided having a stacked core with a pair of outer legs extending between a pair of yokes. The core is arranged in a plurality of layers. Each of the layers includes a pair of yoke plates and a pair of outer leg plates. In an inner-most layer, the width of each yoke plate is less than the width of each outer leg plate. In each of the layers, the inner points of the outer leg plates are substantially in contact with the yoke plates. The cross-section of the inner leg and the outer legs may be rectangular or cruciform.

14 Claims, 10 Drawing Sheets

(56) References Cited

U.S. PATENT DOCUMENTS

| | | | | |
|---|---|---|---|---|
| 3,504,318 | A | 3/1970 | Hattrup et al. | |
| 3,743,991 | A | 7/1973 | Gumpper et al. | |
| 4,136,322 | A | 1/1979 | Maezima | |
| 4,140,987 | A * | 2/1979 | Maezima | 336/60 |
| 4,200,854 | A * | 4/1980 | DeLaurentis et al. | 336/217 |
| 4,201,966 | A * | 5/1980 | De Laurentis | 336/217 |
| 4,283,842 | A * | 8/1981 | DeLaurentis et al. | 29/606 |
| 4,520,556 | A * | 6/1985 | Pasko et al. | 29/606 |
| 4,521,957 | A * | 6/1985 | McLeod | 29/609 |
| 4,523,169 | A | 6/1985 | Hay | |
| 4,724,592 | A | 2/1988 | Hunt et al. | |
| 5,628,861 | A * | 5/1997 | Segal | 156/291 |
| 5,959,523 | A * | 9/1999 | Westberg | 336/234 |
| 7,199,696 | B2 | 4/2007 | Pauley, Jr. et al. | |
| 7,256,677 | B2 * | 8/2007 | Pauley et al. | 336/212 |
| 7,882,615 | B2 * | 2/2011 | Pauley et al. | 29/602.1 |
| 2003/0005570 | A1 | 1/2003 | Weber | |
| 2005/0040924 | A1 * | 2/2005 | LaBoube et al. | 336/5 |
| 2008/0010813 | A1 | 1/2008 | Pauley, Jr. et al. | |

FOREIGN PATENT DOCUMENTS

| | | | |
|---|---|---|---|
| JP | 62-122111 | A | 6/1987 |
| JP | 04-251903 | | 9/1992 |
| WO | 02065488 | A2 | 8/2002 |
| WO | 2011133391 | A3 | 12/2011 |

* cited by examiner

TRANSFORMER HAVING A STACKED CORE

BACKGROUND OF THE INVENTION

The invention relates to transformers and more particularly, to transformers having a stacked core and methods of making the same with reduced waste.

A stacked transformer core is comprised of thin metallic laminate plates, such as grain oriented silicon steel. This type of material is used because the grain of the steel may be groomed in certain directions to reduce the magnetic field loss. The plates are stacked on top of each other to form a plurality of layers. A stacked core is typically rectangular in shape and can have a rectangular or cruciform cross-section. Examples of conventional stacked transformer cores include U.S. Pat. No. 3,157,850 to Winter; U.S. Pat. No. 4,136,322 to Maezima and U.S. Pat. No. 4,200,854 to DeLaurentis et al.

The manufacture of a conventional stacked core typically results in a significant amount of steel being cut away and discarded. Therefore, it would be desirable to provide a stacked transformer core and a method of making the same that reduces the amount of steel that is discarded and, thus, wasted. The present invention is directed to such a transformer core and method.

SUMMARY OF THE INVENTION

In accordance with the present invention, a transformer with a stacked core and a method of making the same are provided. The transformer includes a ferromagnetic core having first and second yokes and a pair of outer legs. Each of the first and second yokes includes a stack of consecutive yoke plates. Each of the yoke plates in the stack has a unitary construction. Each of the first and second outer legs includes a stack of outer leg plates. Each of the outer leg plates has a unitary construction and a trapezoidal shape with an inner longitudinal edge, an outer longitudinal edge and mitered edges extending between the inner and outer longitudinal edges. The mitered edges meet the inner longitudinal edges at inner points, respectively. The core is arranged in a plurality of layers. Each of the layers includes a pair of the yoke plates and a pair of the outer leg plates. In an innermost layer, the width of each yoke plate is less than the width of each outer leg plate. In each of the layers, the inner points of the outer leg plates are substantially in contact with the yoke plates. At least one coil winding is mounted to one of the outer legs.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
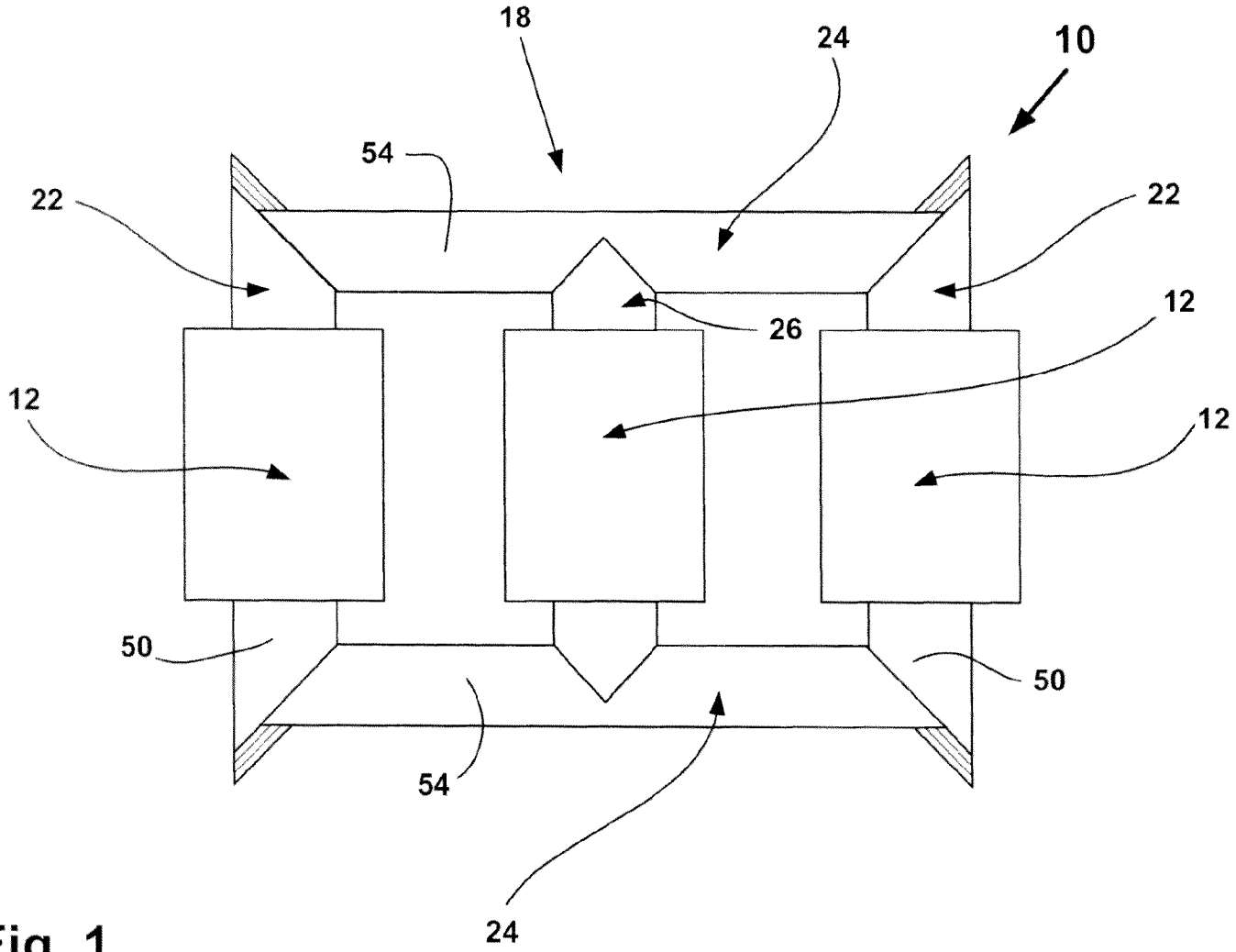
FIG. 1 shows a schematic front elevational view of a transformer having a core embodied in accordance with the present invention.
Figure 2:
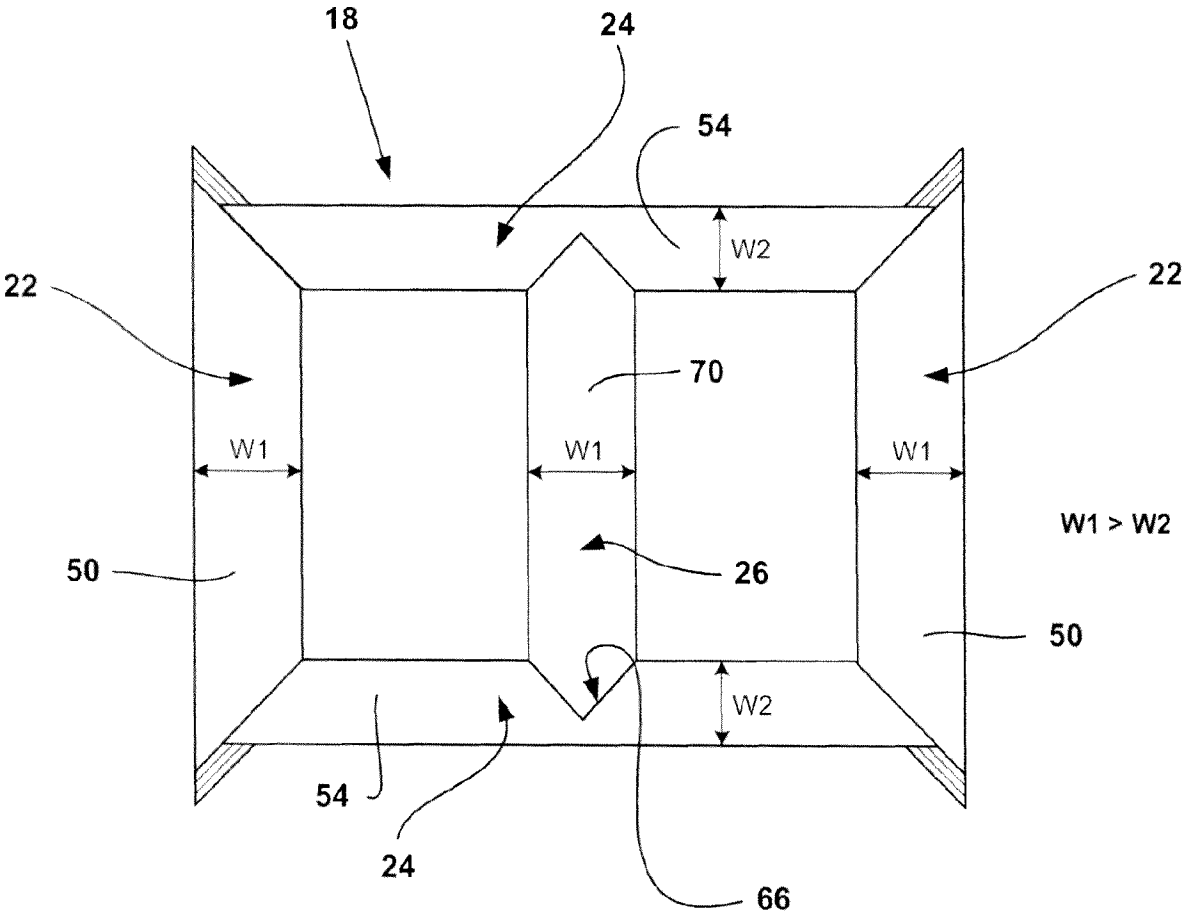
FIG. 2 shows a front elevational view of the core.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown an interior view of a three-phase transformer 10 containing a stacked core embodied in accordance with the present invention. The transformer 10 comprises three winding assemblies 12 (one for each phase) mounted to a stacked core 18. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The winding assemblies 12 are mounted to and disposed around the outer legs 22 and the inner leg 26, respectively. Each winding assembly 12 comprises a low voltage winding and a high voltage winding, each of which is cylindrical in shape. In each winding assembly 12, the high voltage winding and the low voltage winding may be mounted concentrically, with the low voltage winding being disposed within and radially inward from the high voltage winding, as shown in FIG. 1. Alternately, the high voltage winding and the low voltage winding may be mounted so as to be axially separated, with the low voltage winding being mounted above or below the high voltage winding.

The transformer 10 may be an oil-filled transformer, i.e., cooled by oil, or a dry-type transformer, i.e., cooled by air. The construction of the core 18, however, is especially suitable for use in a dry transformer. The transformer 10 may be a distribution transformer having a kVA rating in a range of from about 26.5 kVA to about 15,000 kVA. The voltage of the high voltage windings may be in a range of from about 600 V to about 35 kV and the voltage of the low voltage windings may be in a range of from about 120 V to about 15 kV.

Each outer leg 22 comprises a stack of outer leg plates 50. In each outer leg 22, the outer leg plates 50 are arranged in groups. In one exemplary embodiment of the present invention, the groups each comprise seven outer leg plates 50. Of course, groups of different numbers may be used, such as groups of four, which are used herein for ease of description and illustration. Each of the outer leg plates 50 is composed of grain-oriented silicon steel and has a thickness in a range of from about 7 mils to about 14 mils, with the particular thickness being selected based on the application of the transformer 10. The outer leg plates 50 each have a unitary construction (i.e., are monolithic or undivided) and are trapezoidal in shape. In each of the outer leg plates 50, opposing ends of the plate 50 are mitered at oppositely-directed angles of about 45°, thereby providing the plate 50 with inner (minor) and outer (major) longitudinal edges 51, 52. The outer leg plates 50 have the same width (W1) between the inner and outer longitudinal edges 51, 52, thereby providing each outer leg 22 with a rectangular cross-section. However, the lengths of the outer leg plates 50 are not all the same. More specifically, the lengths within each group of outer leg plates 50 are different. The pattern of different lengths is the same for each group of outer leg plates 50. The difference in lengths within each group permits the formation of the multi-step joints with plates of the yokes, as will be described more fully below.

Each of the yokes 24 has an inner side and an outer side. Each yoke 24 comprises a stack of yoke plates 54 that are arranged in groups of the same number as the outer leg plates 50 of the outer legs 22. Each plate 54 is composed of grain-oriented silicon steel and has a thickness in a range of from about 7 mils to about 14 mils, with the particular thickness being selected based on the application of the transformer 10. The yoke plates 54 each have a unitary construction (i.e., are monolithic or undivided) and are trapezoidal in shape. In each of the yoke plates 54, opposing ends of the plate 54 are mitered at oppositely-directed angles of about 45°, thereby providing the plate 54 with inner (minor) and outer (major) longitudinal edges. The yoke plates 54 have the same width (W2) between the inner and outer longitudinal edges thereof, thereby providing each yoke 24 with a rectangular cross-section. However, the lengths of the yoke plates 54 are not all the same. More specifically, the lengths within each group of yoke plates 54 are different. The pattern of different lengths is the same for each group of yoke plates 54. The difference in lengths within each group permits the formation of multi-step lap joints with the outer leg plates 50 of the outer legs 22, as will be described more fully below.

A V-shaped notch 60 (shown in FIG. 6) is formed in an inner longitudinal edge of each of the yoke plates 54. In each yoke 24, the notches 60 have different depths for forming vertical lap joints with ends of inner leg plates 70 of the inner leg 26, as will be described more fully below. In each yoke 24, the notches 60 form a groove 66 in the yoke 24. The grooves 66 are located inwardly from the outer longitudinal sides of the yokes 24. The grooves 66 extend in the stacking directions of the yokes 24.

The inner leg 26 comprises a stack of inner leg plates 70 arranged in groups of the same number as the yoke plates 54 of the yokes 24. Upper ends of the inner leg plates 70 are disposed in the groove 66 of the upper yoke 24 and lower ends of the inner leg plates 70 are disposed in the groove 66 of the lower yoke 24. The inner leg plates 70 form vertical multi-step lap joints with the yoke plates 54 of the upper and lower yokes 24, as will be described further below. The inner leg plates 70 have the same width (W1) between the longitudinal edges thereof, thereby providing the inner leg 26 with a rectangular cross-section. The inner leg plates 70 may all have the same length if the joints are offset by vertically shifting the inner leg plates 70. Alternately, the inner leg plates 70 may have a plurality of different lengths if the joints are offset by the different lengths of adjacent inner leg plates 70. Each of the inner leg plates 70 has a unitary construction (i.e., are monolithic or undivided) and is trapezoidal in shape. Each end of each inner leg plate 70 is pointed, i.e., V-shaped, so as to fit into a notch 60 of a corresponding yoke plate 54. Each of the inner leg plates 70 is composed of grain-oriented silicon steel and has a thickness in a range of from about 7 mils to about 14 mils, with the particular thickness being selected based on the application of the transformer 10.

In the core 18 described above, the outer leg plates 50 have the same width (W1) as the inner leg plates 70. Thus, the outer legs 22 have the same width (W1) as the inner leg 26. The yoke plates 54 have a width (W2) that is less than the width (W1) of the outer and inner leg plates 50, 54. Thus, the yokes 24 have a width (W2) that is less than the outer and inner legs 22, 26. W2 may be from about 1% to about 50% less than W1, more particularly from about 1% to about 35% less than W1, still more particularly from about 1% to about 15% less than W1. In one embodiment of the invention, W2 is seven inches and W1 is eight inches.

Figure 3:
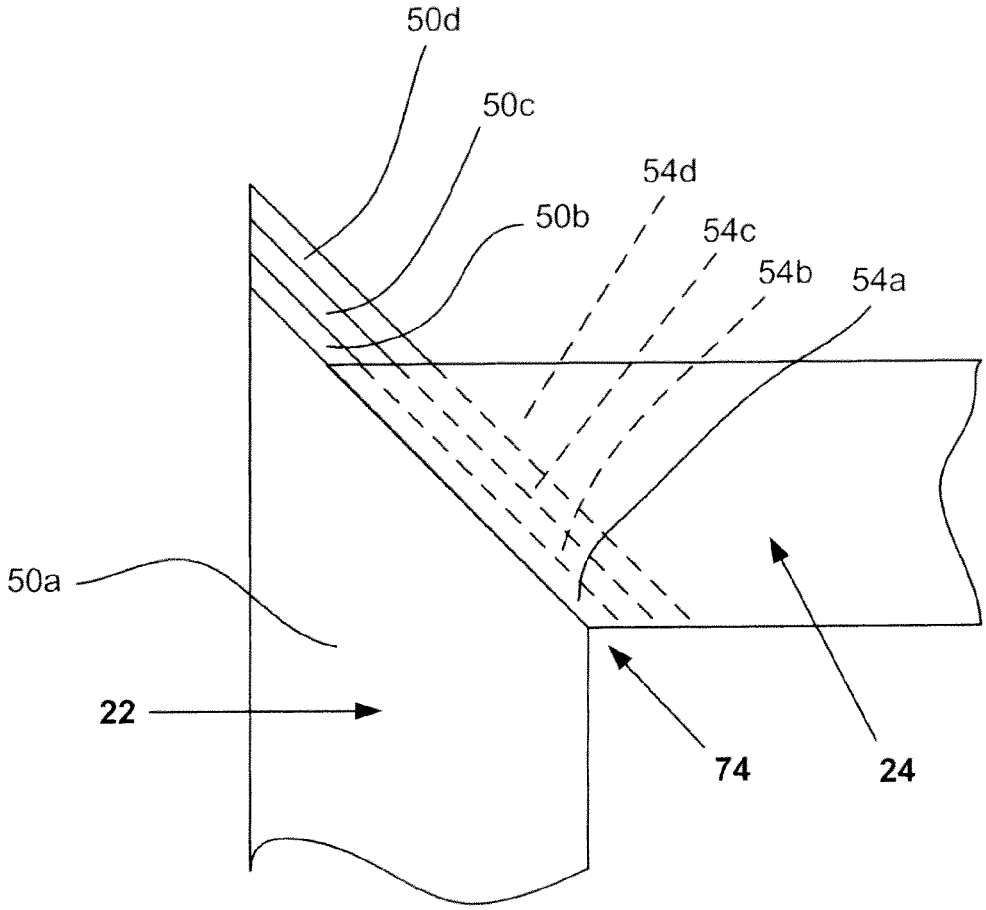
FIG. 3 shows a close-up view of a connection between a first outer leg and an upper yoke of the transformer core.
Figure 4:
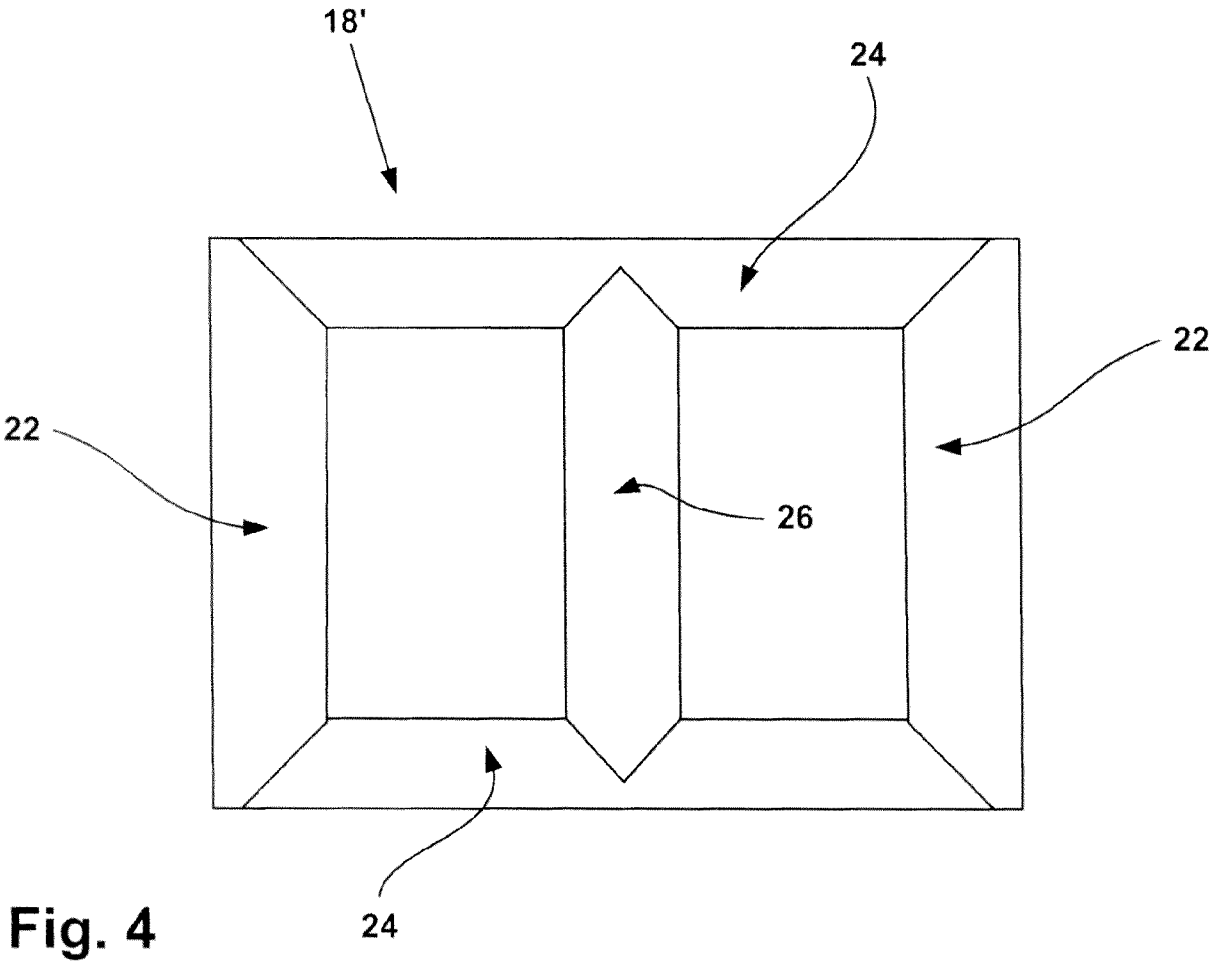
FIG. 4 shows a front elevational view of the core with outer ends of the outer legs being clipped.

Referring now to FIG. 3, there is shown an enlarged view of a portion of the connection 74 between the upper end of a first outer leg 22 and an upper yoke 24. More specifically, the ends of first, second, third and fourth outer leg plates 50*a, b, c, d* of the first outer leg 22 abut or are in close proximity to (i.e., form joints with) the ends of first, second, third and fourth yoke plates 54*a*, 54*b*, 54*c*, 54*d* of the upper yoke 24, respectively. The first through fourth outer leg plates 50*a-d* of the first outer leg 22 and the first through fourth yoke plates 54*a-d* of the upper yoke 24 are successively disposed farther inwardly (in the stacking direction of the core 18). The first through fourth outer leg plates 50*a-d* have successively longer lengths, whereas the first through fourth yoke plates 54*a-d* have successively shorter lengths. With this construction, the first yoke plate 54*a* overlaps the joint between the second yoke plate 54*b* and the second outer leg plate 50*b*, the second yoke plate 54*b* overlaps the joint between the third yoke plate 54*c* and the third outer leg plate 50*c* and the third yoke plate 54*c* overlaps the joint between the fourth yoke plate 54*d* and the fourth outer leg plate 50*d*. As shown, the outer end points of the outer leg plates 50*a-d* of the first outer leg 22 are located outward (upward) from the upper yoke 24. These outer end points may be removed to improve the appearance of the core, as shown in FIG. 4 (with the core having the reference numeral 18'). Although not shown, additional groups of four plates 114, 120 are provided and repeat the pattern of the first through fourth yoke plates 54*a-d* and the first through fourth outer leg plates 50*a-d*. In this manner, multi-step lap joints are formed between the yoke plates 54 of the upper yoke 24 and the outer leg plates 50 of the first outer leg 22, with yoke plates 54 of the upper yoke 24 overlapping outer leg plates 50 of the first outer leg 22.

The other connections between the first and second outer legs 22 and the upper and lower yokes 24 are constructed in the same manner as the connection 74 so as to have multi-step lap joints. It should be appreciated, however, that all of the connections may have a different type of construction. For example, instead of the connections having a four step lap joint pattern (as shown), the connections may have a seven, eight or other number step lap joint pattern.

Figure 5:
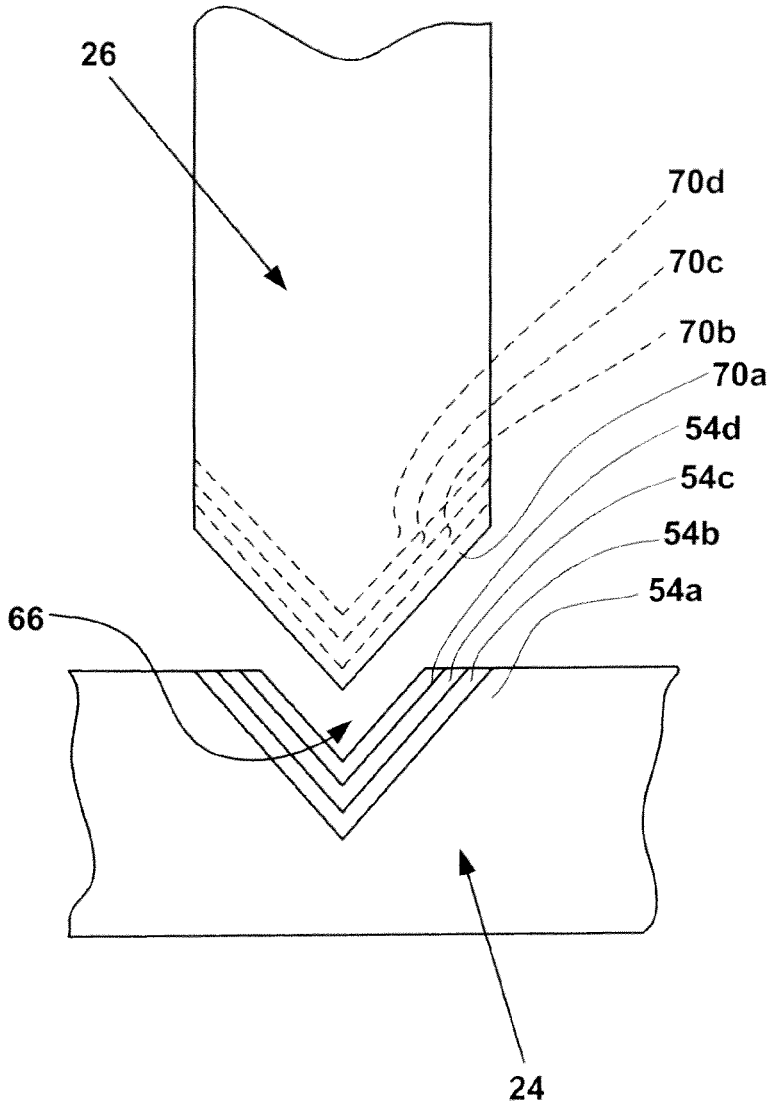
FIG. 5 shows an enlarged view of a portion of an inner leg spaced above a lower yoke of the transformer core.

Referring now to FIG. 5 there is shown an enlarged view of a portion of the lower end of the inner leg 26 spaced from the lower yoke 24. When the lower end of the inner leg 26 is disposed in the lower groove 66, the ends of first, second, third and fourth inner leg plates 70*a, b, c, d* of the inner leg 26 abut or are proximate to (i.e., form joints with) lower interior edges of first, second, third and fourth yoke plates 54*a, b, c, d* of the lower yoke 24, respectively. The first through fourth inner leg plates 70*a-d* are vertically offset such that lower ends thereof are located successively farther upward. In order to accommodate these differences in length, the lower interior edges of the yoke plates 54*a-d* are cut successively shallower. With this construction, the first plate 70*a* overlaps the joint between the second inner leg plate 70*b* and the second plate 54*b*, the second plate 70*b* overlaps the joint between the third inner leg plate 70*c* and the third plate 54*c*, and the third plate 70*c* overlaps the joint between the fourth inner leg plate 70*d* and the fourth plate 54*d*. Although not shown, additional groups of the yoke plates 54 and inner leg plates 70 are provided and repeat the pattern of the first through fourth plates 70*a-d* and the first through fourth yoke plates 54*a-d*. In this manner, multi-step lap joints are formed between the yoke plates 54 of the lower yoke 24 and the inner leg plates 70 of the inner leg 26.

If the inner leg plates 70 are the same length, upper ends of the first through fourth inner leg plates 70*a-d* of the inner leg 26 are located successively farther upward since the lower ends of the first through fourth inner leg plates 70*a-d* of the inner leg 26 are located successively farther upward. As a result, the upper interior edges (and, thus, the upper notches 60) of the yoke plates 54 within each group are successively deeper, which is the inverse of the lower yoke 24. With this construction, vertical multi-step lap joints are formed between the yoke plates 54 of the upper yoke 24 and the first inner leg plates 70 of the inner leg 26, with yoke plates 54 of the upper yoke 24 overlapping inner leg plates 70. If the inner leg plates 70 are not of the same length, the arrangement of the joints between the inner leg plates 70 and the upper yoke 24 may be the same as that between the inner leg plates 70 and the lower yoke 24.

Figure 7:
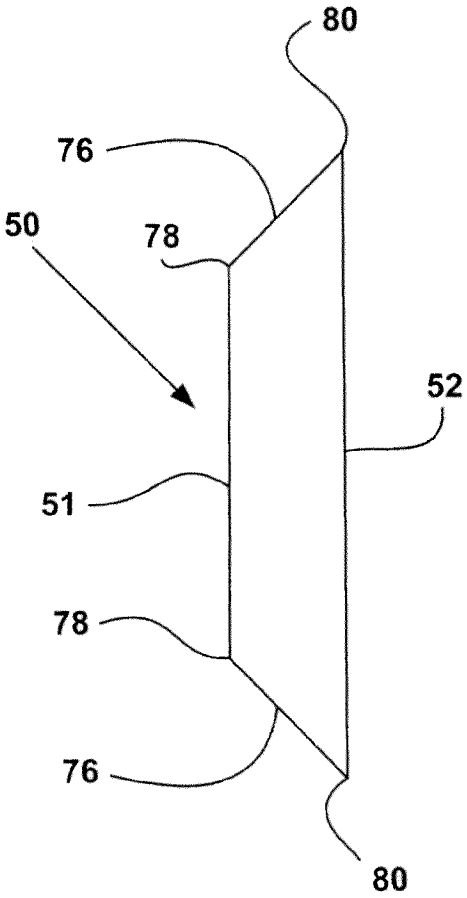
FIG. 7 shows a front elevational view of an outer leg plate.
Figure 6:
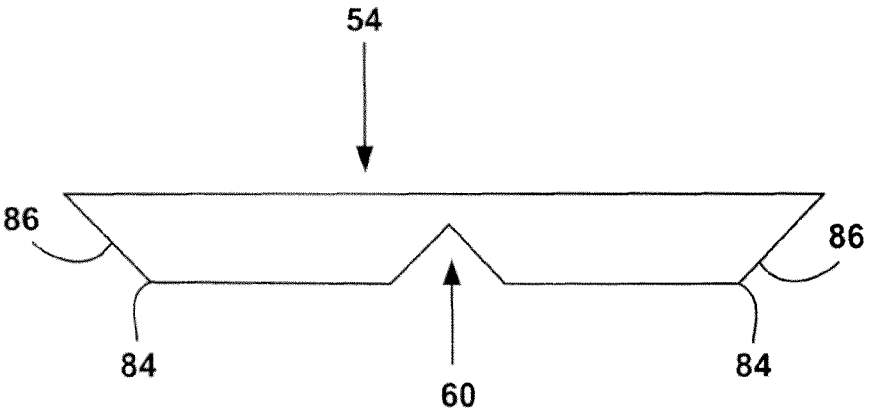
FIG. 6 shows a front elevational view of a yoke plate.
Figure 8:
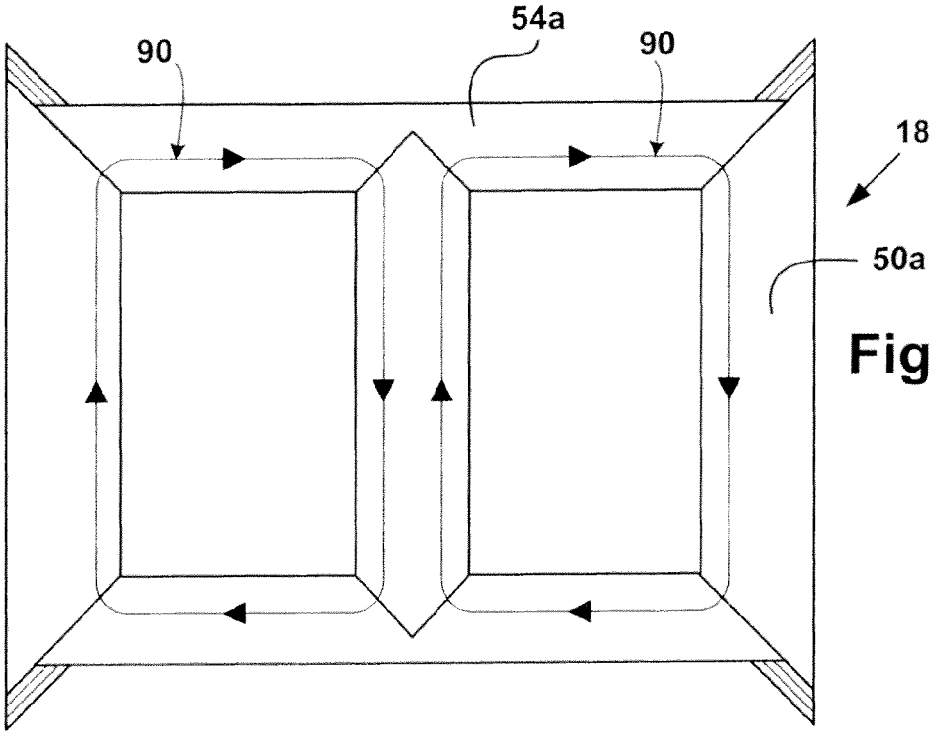
FIG. 8 shows a front elevational view of the transformer core showing magnetic flux travel paths.
Figure 9:
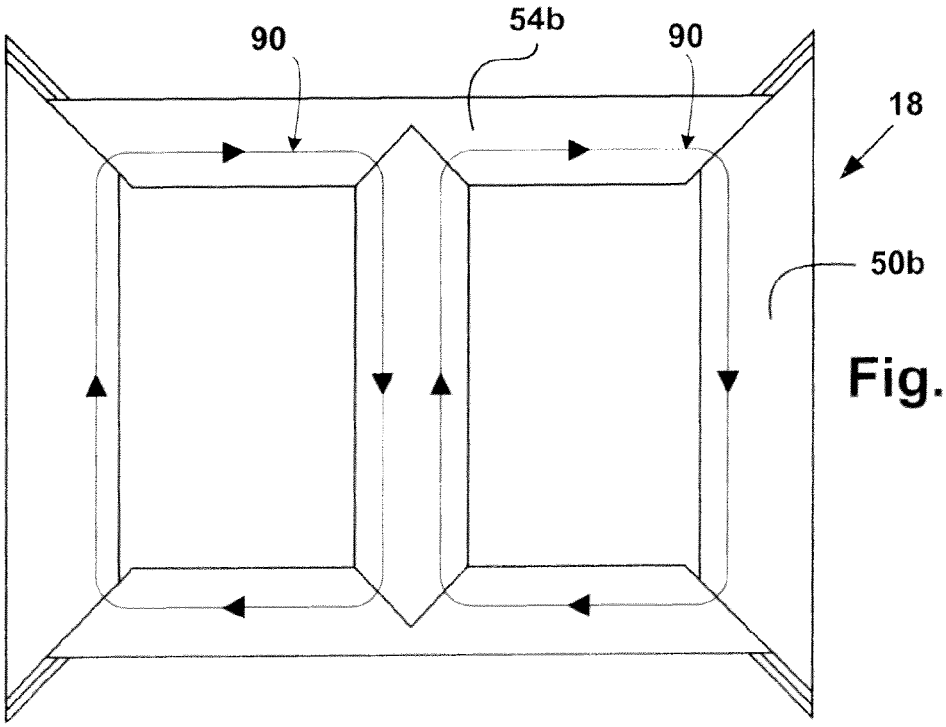
FIG. 9 shows a front elevational view of the transformer core with an outermost layer of plates removed and showing magnetic flux travel paths.

Referring now to FIGS. 6-7, there is shown one of the yoke plates 54 of one of the yokes 24 and one of the outer leg plates 50 of one of the outer legs 22, respectively. As set forth above, the plate 50 has inner and outer longitudinal edges 51, 52. At each end of the plate, a mitered edge 76 extends between the inner and outer longitudinal edges 51, 52. Inner ends of the mitered edges 76 meet ends of the inner longitudinal edge 51 at inner points 78, respectively. Outer ends of the mitered edges 76 meet ends of the outer longitudinal edge 52 at outer points 80, respectively. The core 18 is constructed such that in each of the stacking layers, the inner points 78 of the plate 50 are in contact with or closely proximate to the corresponding yoke plates 54 of the yokes 24, respectively. For example, in an outermost, first stacking layer, the inner points 78 of the first plate 50*a* are in contact with or closely proximate to inner points 84 of the yoke plates 54*a* of the yokes 24, respectively, as shown in FIG. 8. In a second stacking layer, the inner points 78 of the second plate 50*b* are in contact with or closely proximate to mitered edges 86 of the second yoke plates 54*b* of the yokes 24, respectively, outward from the inner points 84 of the yoke plates 54*b*, as shown in FIG. 9. The contact/close proximity of the inner points 78 of the outer leg plates 50 to the yoke plates 54 in each stacking layer is believed to help minimize core losses. In this regard, the magnetic flux travel paths (represented by the arrowed lines 90) in the core 18 circulate from the outer legs 22 to the inner leg 26, as shown in FIGS. 8-9. It is believed that the flux travel paths are more concentrated in the inner-most portion of the core 18, toward the inside corners formed between the outer legs 22 and the yokes 24, i.e., where the inner points 78 are located. This inner concentration of the magnetic flux permits the widths of the yokes 24 to be reduced. As a result of the reduced widths of the yokes 24 and the contact/close proximity of the inner points 78 of the outer leg plates 50 to the yoke plates 54, the outer points 80 of the outer leg plates 50 are all spaced from (i.e., not in close proximity to) the yoke plates 54.

Figure 10:
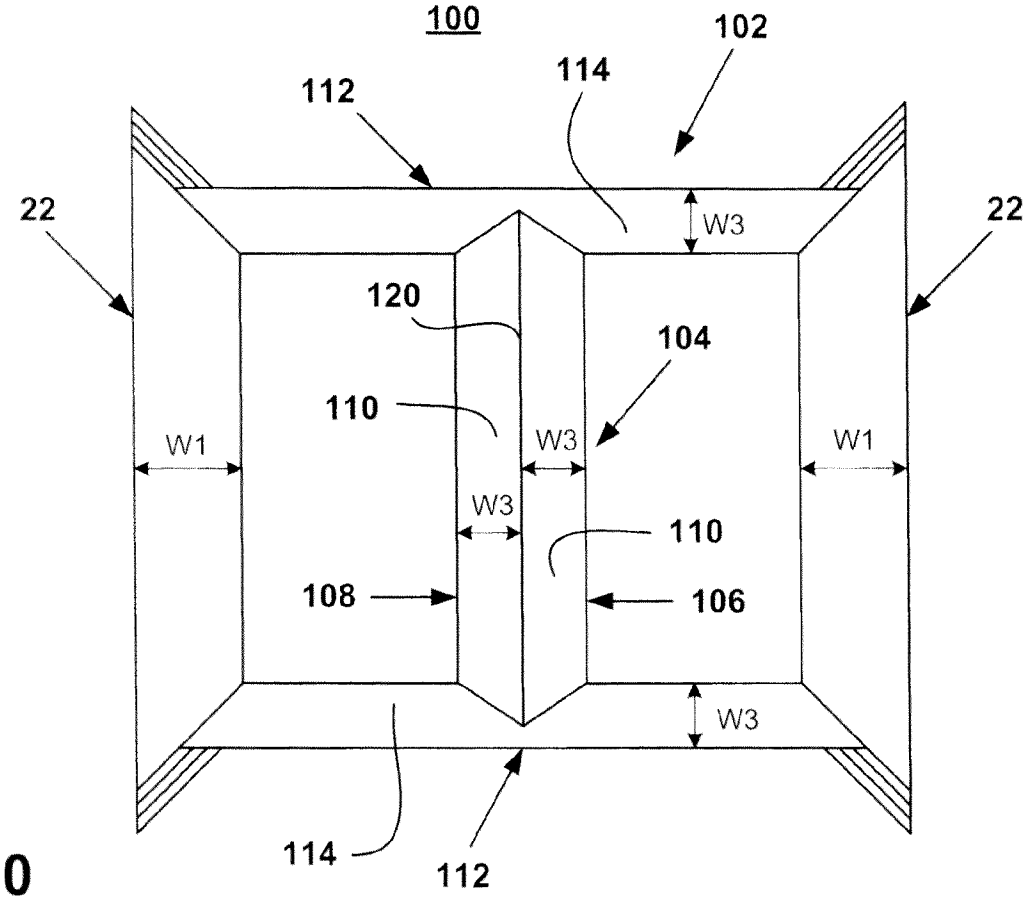
FIG. 10 shows a front elevational view of a transformer core constructed in accordance with a second embodiment of the present invention.

Referring now to FIG. 10, there is shown a portion of a transformer 100 embodied in accordance with a second embodiment of the present invention. The transformer 100 has substantially the same construction as the transformer 10, except for the differences set forth below. The transformer 100 has a core 102 with an inner leg 104 comprised of two stacks 106, 108 of inner leg plates 110. In addition, the core 102 has yokes 112 comprised of yoke plates 114. The yoke plates 114 have substantially the same construction as the yoke plates 54, except the yoke plates 114 may have a reduced width. The yokes 112 form joints with the outer legs 22 in the same manner as described above with regard to the core 18.

In each of the first and second stacks 106, 108, the inner leg plates 110 are arranged in groups of the same number as the yoke plates 114. The first and second stacks 106, 108 abut each other along a seam 120 that extends in the longitudinal direction of the inner leg 104. Upper ends of the first and second stacks 106, 108 are disposed in an upper groove of the upper yoke 112 and lower ends of the first and second stacks 106, 108 are disposed in a lower groove of the lower yoke 112. The inner leg plates 110 form vertical multi-step lap joints with the yoke plates 114 of the upper and lower yokes 112. The inner leg plates 110 may all have the same length if the joints are offset by vertically shifting the inner leg plates 110. Alternately, the inner leg plates 110 may have a plurality of different lengths if the joints are offset by the different lengths of adjacent inner leg plates 110. Each of the inner leg plates 110 has a unitary construction and is trapezoidal in shape. In each of the inner leg plates, opposing ends of the inner leg plate 110 are mitered at oppositely-directed angles of about 45°, thereby providing the inner leg plate with major and minor side edges. The lengths of the inner leg plates 110 are determined by the major side edges. Each of the inner leg plates 110 is composed of grain-oriented silicon steel and has a thickness in a range of from about 7 mils to about 14 mils, with the particular thickness being selected based on the application of the transformer 100. Each of the inner leg plates 110 has a width (W3), which is one-half of the width (W1) of the outer leg plates 50 of the outer legs 22. In this manner, the inner leg has 104 has substantially the same width as the outer legs 22.

In one embodiment of the present invention, the yoke plates 114 of the yokes 112 may have the same width (W3) as the inner leg plates 110. In this manner, the yoke plates 114 and the inner leg plates 110 may be formed from the same roll(s) of metal.

In the embodiments described above, the legs and yokes have rectangular cross-sections. It should be appreciated, however, that embodiments of the present invention may be provided, wherein at least the legs are provided with cruciform cross-sections. Such an embodiment is shown in FIG. 11.

Figure 11:
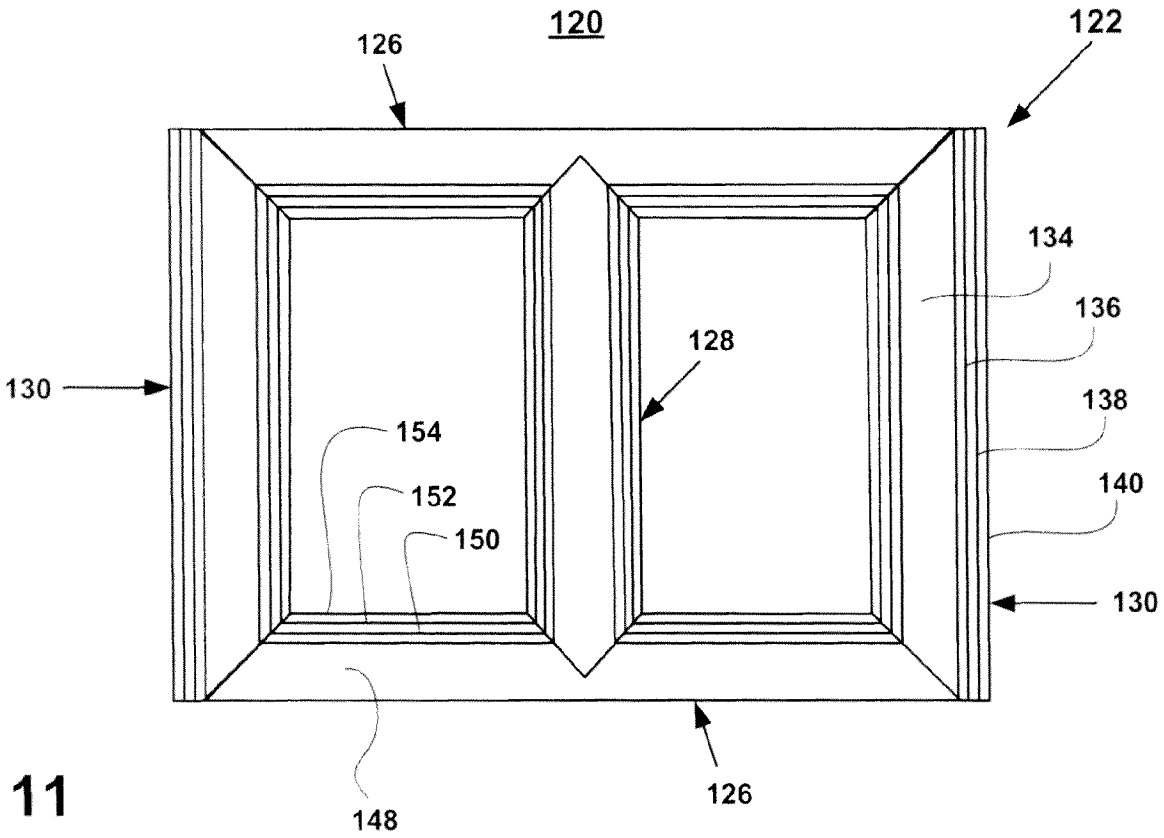
FIG. 11 shows a front elevational view of a transformer core constructed in accordance with a third embodiment of the present invention.

With reference now to FIG. 11, a portion of a transformer 120 having a core 122 is shown. The core 122 comprises yokes 126, an inner leg 128 and outer legs 130. Instead of having a rectangular cross-section, each of the inner leg 128 and the outer legs 130 has a cruciform cross-section that approximates a circle (see FIG. 12). The cruciform cross-sections of these components increase the strength of the core 122 and provide the inner leg 128 and the outer legs 130 with larger surface areas for supporting coils. The cruciform cross-sections of these components of the core are formed by providing the constituent plates of the components with varying widths. For example, each outer leg may have sections 134, 136, 138, 140, 142, 144, 146 of varying widths. Each of the sections 134-146 comprises one or more groups of plates having different lengths to form step lap joints, as described above for the core 18. The sections 134-140 of each outer leg 130 have different widths, respectively. The sections 142-146 have the same widths as the sections 134-138, respectively. Section 140 has the greatest width (designated W4) and may also have the greatest thickness or depth (in the stacking direction).

Figure 13:
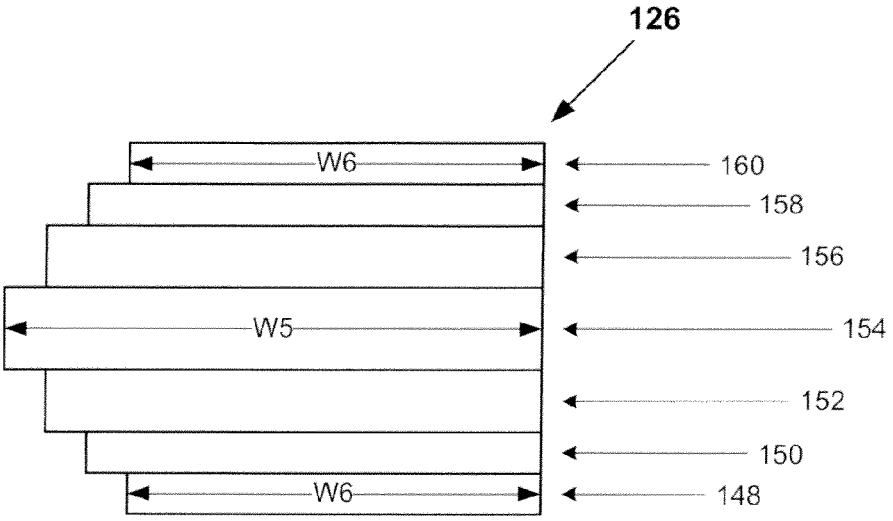
FIG. 13 shows a cross-section of a yoke of the transformer core constructed in accordance with the third embodiment

Each yoke 126 may have sections 148, 150, 152, 154, 156, 158, 160 with varying widths. The sections 148-160 may have widths that provide each yoke 126 with a semi-cruciform cross-section, as shown in FIG. 13. This semi-cruciform cross-section has a substantially flat outer side and an irregular inner side that approximates a half-circle. Each of the sections 148-160 comprises one or more groups of plates having different lengths to form step lap joints, as described above for the core 18. The sections 148-154 of each yoke 126 have different widths, respectively. The sections 156-160 have the same widths as the sections 148-152, respectively. Section 154 has the greatest width (designated W5) and may also have the greatest thickness or depth (in the stacking direction).

Figure 12:
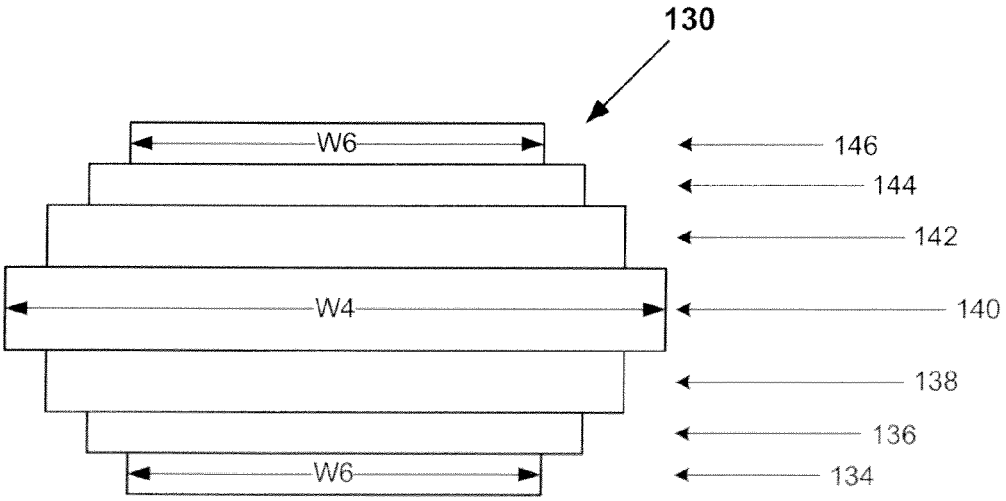
FIG. 12 shows a cross-section of an outer leg of the transformer core constructed in accordance with the third embodiment.

The sections 134-146 of the outer legs 130 correspond to the sections 148-160 of the yokes, respectively, e.g., the plates of the sections 134 form step lap joints with the plates of the sections 148 etc. Within the corresponding sections of the yokes 126 and the outer legs 130, the plates of the yokes 126 have a narrower width than the plates in the outer legs 130, except for two or more of the outer sections. For example, as shown in FIGS. 12-13, the innermost section 140 of the outer legs 130 has a width W4 that is greater than the width W5 of the corresponding innermost section 154 of the yokes 126, whereas the outermost sections 134, 146 of the outer legs 130 have the same width (W6) as the outermost sections 148, 160 of the yokes 126.

Although only three-phase transformers have been shown and described, the present invention is not limited to a three-phase transformer. Single-phase transformers constructed in accordance with the present invention may also be provided. Single-phase transformers may be provided having substantially the same construction as the transformer 10 and the transformer 120, respectively, except for the differences described below. The core of each single-phase transformer does not have the inner leg (26 or 128, as the case may be). In addition, in the core of each single-phase transformer, the yoke plates do not have the V-shaped notches and are shorter in length so that the outer legs (22 or 130, as the case may be) are positioned closer together. In each single-phase transformer, only one winding assembly 12 is provided and is mounted to one of the outer legs (22 or 130, as the case may be).

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A three-phase distribution transformer comprising:

(a.) a ferromagnetic core comprising:

first and second yokes, each having an inner longitudinal side and an outer longitudinal side and each comprising a stack of consecutive yoke plates, each of the yoke plates having a unitary construction; and first and second outer legs each having a cruciform cross-section, each of which comprises a stack of outer leg plates, each of the outer leg plates having a unitary construction and a trapezoidal shape with an inner longitudinal edge, an outer longitudinal edge and mitered edges extending between the inner and outer longitudinal edges, the mitered edges meeting the inner longitudinal edges at inner points, respectively; and an inner leg disposed between the first and second outer legs, the inner leg comprising a stack of inner leg plates;

wherein the core is arranged in a plurality of layers, each of the layers comprising a pair of the yoke plates, at least one inner leg plate and a pair of the outer leg plates;

wherein in an innermost layer, the width of each yoke plate is less than the width of each outer leg plate;

wherein in outermost layers on opposing sides of the core, the yoke plates have the same width as the outer leg plates; and wherein in each of the layers, the inner points of the outer leg plates are in contact with the yoke plates; and (b.) at least one coil winding mounted to one of the outer legs.

2. The three-phase transformer of claim 1, wherein in each of the outer leg plates, the mitered edges meet the outer longitudinal edges at outer points, respectively, and wherein all of the outer points are disposed outwardly from the yokes.

3. The three-phase transformer of claim 1, wherein in the innermost layer, the width of each yoke plate is from about 1% to about 15% less than the width of each outer leg plate.

4. The three-phase transformer of claim 1, wherein the first and second yokes each have a semi-cruciform cross-section with an inner side that approximates a semi-circle and an outer side that is substantially flat.

5. The three-phase transformer of claim 1, wherein the outer legs and the yokes each have a rectangular cross-section.

6. The three-phase transformer of claim 5, wherein in each of the layers, each yoke plate has a width that is less than the width of each outer leg plate.

7. The three-phase transformer of claim 6, wherein in each of the layers, the width of each yoke plate is from about 1% to about 15% less than the width of each outer leg plate.

8. The three-phase transformer of claim 1, wherein each of the yoke plates includes an inner longitudinal edge with a V-shaped notch formed therein, the V-shaped notches of the yoke plates forming a groove in each of the yokes that extends in the stacking direction of the yoke plates and is located inwardly from the outer longitudinal side of the yoke; and wherein the inner leg has opposing ends disposed in the grooves of the yokes, respectively.

9. A three-phase distribution transformer comprising:

(a.) a ferromagnetic core comprising:

first and second yokes, each having an inner longitudinal side and an outer longitudinal side and each comprising a stack of consecutive yoke plates, each of the yoke plates having a unitary construction, wherein each of the yoke plates includes an inner longitudinal edge with a V-shaped notch formed therein, the V-shaped notches of the yoke plates forming a groove in each of the yokes that extends in the stacking direction of the yoke plates and is located inwardly from the outer longitudinal side of the yoke; and first and second outer legs, each of which comprises a stack of outer leg plates, each of the outer leg plates having a unitary construction and a trapezoidal shape with an inner longitudinal edge, an outer longitudinal edge and mitered edges extending between the inner and outer longitudinal edges, the mitered edges meeting the inner longitudinal edges at inner points, respectively; and an inner leg disposed between the first and second outer legs, wherein the inner leg has opposing ends disposed in the grooves of the yokes, respectively, the inner leg comprising a stack of inner leg plates, wherein the stack of inner leg plates is a first stack of inner leg plates and wherein the inner leg further comprises a second stack of inner leg plates abutting the first stack of inner leg plates;

wherein the core is arranged in a plurality of layers, each of the layers comprising a pair of the yoke plates, at least one inner leg plate and a pair of the outer leg plates, and wherein each of the layers of the core comprises a pair of the inner leg plates that adjoin each other along their inner longitudinal edges;

wherein in an innermost layer, the width of each yoke plate is less than the width of each outer leg plate; and wherein in each of the layers, the inner points of the outer leg plates are in contact with the yoke plates; and (b.) at least one coil winding mounted to one of the outer legs.

10. The three-phase transformer of claim 9, wherein in each of the layers, the width of each of the inner leg plates is the same as the width of each of the yoke plates.

11. The three-phase transformer of claim 1, wherein the yoke plates form multi-step lap joints with the outer leg plates.

12. The three-phase transformer of claim 1, wherein each of the yoke plates and the outer leg plates is composed of grain-oriented silicon steel.

13. The three-phase transformer of claim 1, wherein the transformer is a dry transformer.

14. The three-phase transformer of claim 1, wherein the first and second yokes each have an outer side that is substantially flat.

* * * * *